US007712275B2

(12) United States Patent
Kelly

(10) Patent No.: US 7,712,275 B2
(45) Date of Patent: May 11, 2010

(54) METHOD FOR REDUCING ROOF MEMBRANE DAMAGE FROM HAIL/FASTENER CONTACT IMPACT AND A ROOF SYSTEM HAVING REDUCED MEMBRANE DAMAGE FROM HAIL/FASTENER IMPACT

(76) Inventor: Thomas L. Kelly, 31 Sands St., Waterbury, CT (US) 06710

( * ) Notice: Subject to any disclaimer, the term of this patent is extended or adjusted under 35 U.S.C. 154(b) by 970 days.

(21) Appl. No.: 10/702,030

(22) Filed: Nov. 4, 2003

(65) Prior Publication Data

US 2005/0102939 A1 May 19, 2005

(51) Int. Cl.
*E04D 5/14* (2006.01)
*E04D 13/16* (2006.01)

(52) U.S. Cl. ..... 52/520; 52/410; 52/545; 52/543; 52/746.11

(58) Field of Classification Search ..... 52/3, 52/198, 518, 520, 543, 545, 549, 410, 512, 52/746.11, 741.4
See application file for complete search history.

(56) References Cited

U.S. PATENT DOCUMENTS 4,382,353 A * 5/1983 Kelly ..... 52/410
4,437,283 A * 3/1984 Benoit ..... 52/410
4,493,175 A * 1/1985 Coppola, Jr. ..... 52/410
4,546,589 A * 10/1985 Seaman ..... 52/518
4,588,637 A * 5/1986 Chiu ..... 428/355 BL
4,631,887 A * 12/1986 Francovitch ..... 52/410
4,649,686 A * 3/1987 Backenstow et al. ..... 52/509
4,747,241 A * 5/1988 Whitman ..... 52/410
4,841,706 A * 6/1989 Resan ..... 52/410
4,885,887 A * 12/1989 Simmons et al. ..... 52/410
4,977,720 A * 12/1990 Kuipers ..... 52/410
5,204,148 A * 4/1993 Alexander et al. ..... 428/41.8
5,419,666 A * 5/1995 Best ..... 411/373
5,711,116 A * 1/1998 Hasan ..... 52/58
6,233,889 B1 * 5/2001 Hulsey ..... 52/302.1
6,502,360 B2 * 1/2003 Carr et al. ..... 52/408
6,516,572 B1 * 2/2003 Nowacek et al. ..... 52/90.1
7,146,771 B2 * 12/2006 Swann ..... 52/518

* cited by examiner

*Primary Examiner*—Phi Dieu Tran A
(74) *Attorney, Agent, or Firm*—Cantor Colburn LLP

(57) ABSTRACT

Disclosed herein is a method for reducing roof membrane damage from hail/fastener impact by locating a fastener, positioning an energy absorbing material over the fastener and affixing the material to the fastener. Further disclosed herein is a roof system with reduced hail/fastener impact damage characteristics. The system comprises a roof substrate having one or more layers of material at least one fastener exposed at a top surface of the substrate and a dedicated energy absorbing material positioned over the at least one fastener. A roof water proofing membrane is placed atop the foregoing elements.

11 Claims, 3 Drawing Sheets

METHOD FOR REDUCING ROOF MEMBRANE DAMAGE FROM HAIL/FASTENER CONTACT IMPACT AND A ROOF SYSTEM HAVING REDUCED MEMBRANE DAMAGE FROM HAIL/FASTENER IMPACT

BACKGROUND

In the roofing industry and particularly the commercial roofing industry, exposed roofing membranes have become prevalent. Single ply roofing systems, and others using an exposed membrane, although very effective are subject to greater damage from hail impact than some other types of roof systems. One significant exacerbator of the potential for damage from hail is the very fasteners that retain the membrane and roof assembly component materials underlying the membrane. Such fasteners are nails, special clips, anchors or screws and typically have washers positioned thereunder to spread the hold down load of the head of the fastener. Because fasteners are generally immovable, connected to structural subjacent roof support materials or otherwise substantially immoveable, they pose particular risks to the overlying waterproofing membrane when hail strikes. The fastener/washer act essentially as an anvil against which the roofing membrane can be suddenly and violently compressed by the substantial momentum transfer from a hail stone. This compression tends to rapidly and for short duration "flow" the membrane material in all directions from the impact site. Rupture of the overlying waterproofing membrane can easily occur when hail hits the membrane in an area of an underlying fastener. In order to improve the hail resistance of such roof structures, this characteristic must be alleviated. The roofing industry tests for hail presently utilize a ½" to 2" steel ball. The ball is accelerated to terminal (free full) velocity and directed at a roof assembly to measure hail impact. Recently, hail testing has been developed further to enable the shooting of actual ice balls from an air cannon through a timing device at a roof assembly which has been cooled to 38° F. with chilled water. This test more realistically shows the effects of various size hail ice balls from ½" to 5" diameter at various mph speeds into a roof assembly sample. A 3" hail ball approximately the size of a baseball will fall in still air at 95 to 97 mph. If the 3" hail is caught in a down draft of wind it can increase its speed. Some 3" hail impact dents on sheet metal equipment on roofs hit by hail required a 3" hail ball to be shot at 150 mph to replicate the dent. At 100 mph, a 3" hail ball will go through ½ inch APA approved oriented strand board (osb) wafer board and at 135 mph and a 3" hail ball will go through ½" plywood.

SUMMARY

Disclosed herein is a method for reducing roof membrane damage from hail/fastener impact by locating a fastener, positioning an energy absorbing material over said fastener and affixing said material to said fastener.

Further disclosed herein is a roof system with reduced hail/fastener impact damage characteristics. The system comprises a roof substrate having one or more layers of material at least one fastener exposed at a top surface of said substrate and a dedicated energy absorbing material positioned over said at least one fastener. A roof water proofing membrane is placed atop the foregoing elements.

BRIEF DESCRIPTION OF THE DRAWINGS

Referring now to the drawings wherein like elements are numbered alike in the several Figures.

DETAILED DESCRIPTION

Figure 1:
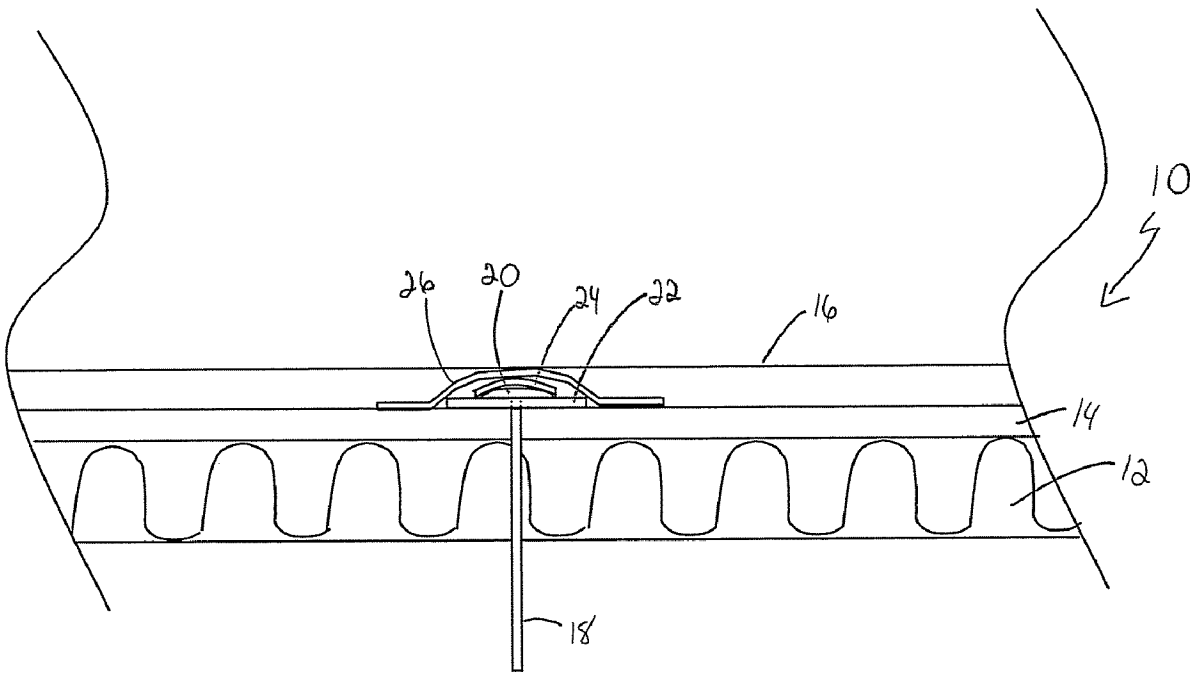
FIG. 1 is a schematic cross-sectional elevational view of a fastener in a representative roof assembly with a dedicated energy absorbing material thereafter.

Referring to FIG. 1, one of ordinary skill in the art will recognize the schematic representation of a roof assembly 10 comprising simply for purposes of illustration, insulation 12, cover board 14 and a roof waterproofing membrane 16. A fastener 18 is illustrated extending through board 14 and insulation 12. Fastener 18 includes a head 20 and is employed in one embodiment with a washer 22 to spread the hold-down load on the cover board 14. In the method disclosed herein, locating a fastener 18 is intended to encompass, at least, placing a fastener in the roof assembly or finding a fastener already in the roof structure, regardless of who put it there or when. Once fastener 18 has been located, whether or not the specific fastener employs a washer (washer embodiment is illustrated). Energy absorbing material, which as illustrated is two layers 24 and 26 but may be more or one layer if desired, is/are disposed over fastener head 20 and washer 22. As illustrated, it is noted that layer 24 is large enough in perimetral dimension to cover only fastener head 20. Layer 26 then is dimensioned to cover layer 24 and washer 22. It will be understood that each layer 24, 26 could be large enough in perimetral dimension to cover both fastener head 20 and washer 22 if desired.

The energy absorbing material may comprise ethylene propylene diene monomer (EPDM), butyl rubber, EPDM with a butyl gum rubber bottom or other flowable material as a combination including at least one of the foregoing, and in one embodiment is affixed to fastener head 20 and washer 22 by adhering. The adhering may be by applying an adhesive material to the fastener head/washer or to the energy absorbing material during installation of the energy absorbing material, or may be simply by sticking down (self-stick) the energy absorbing material having had an adhesive pre-applied thereto.

Figure 2:
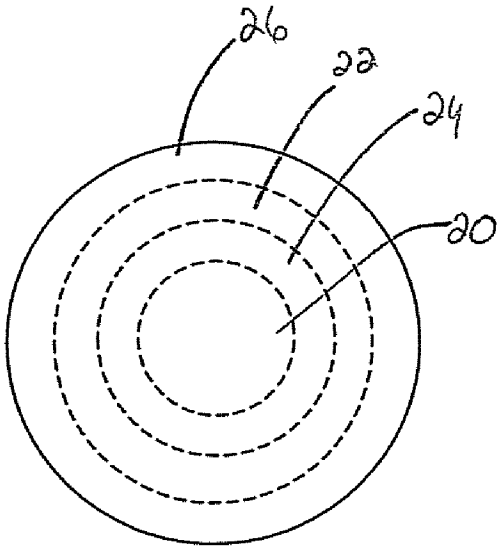
FIG. 2 is a top plan view of the fastener and energy absorbing material.

It is to be understood that the roof structure illustrated in FIG. 1 is only for purposes of illustrating an environment in which the method and system disclosed herein is employed and that other and different roof assemblies are equally benefited by the method and system described herein. In addition, although FIG. 2 illustrates a rounded perimetral shape of the energy absorbing material, other shapes such as square, rectangular, triangular, oval, polygonal, etc. are acceptable substitutes providing at least the head 20 of fastener 18 is covered and in one embodiment both head 20 and washer 22 are covered.

Figure 3:
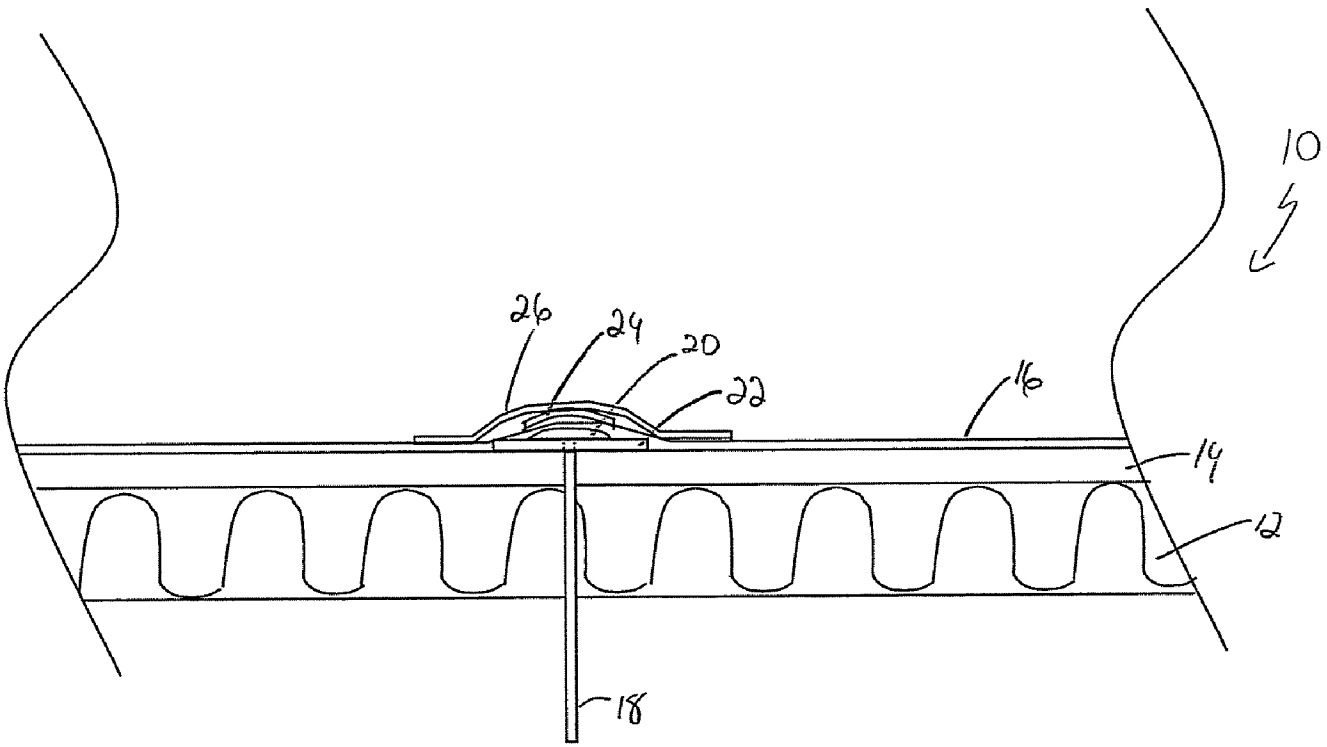
FIG. 3 is a schematic cross-sectional elevational view of an alternate embodiment of the FIG. 1 embodiment.

In an alternate embodiment hereof, the energy absorbing layer(s) may be placed on top of the waterproofing membrane directly over a fastener instead of being applied directly to the fastener with similar beneficial results. This is illustrated in FIG. 3 with all similar elements from FIG. 1 carrying identical designations and the energy absorbing material carrying similar designations but bearing the alpha character "a" as a postscript.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A method for reducing damage in a roof membrane of a roof substrate caused by hail/fastener impact comprising:

locating fasteners in a roof construction such that a top of said fastener is exposed at a top surface of the roof substrate;

positioning at least two individual pieces of energy absorbing material that are non-metallic to discretely cover each individual fastener of said fasteners whereby said fastener is completely covered by both of said at least two pieces, said at least two pieces including a first piece that is positioned and dimensioned to directly contact said top of said fastener, such that said first piece is positioned and dimensioned to cover a substantial entirety of a top surface of no other roofing component; and affixing said first piece to said top of fastener;

affixing a second piece of said at least two individual pieces of energy absorbing material to a relative top of said first piece, wherein said second piece covers a substantial entirety of a top surface of said first piece, and wherein said fastener is disposed entirely out of contact with said second piece; and positioning a roof waterproofing membrane atop all forgoing elements.

2. A method for reducing roof membrane damage from hail/fastener contact as claimed in claim 1 wherein said affixing is by adhering.

3. A method for reducing roof membrane damage from hail/fastener contact as claimed in claim 2 wherein said adhering is by a self stick adhesive applied to said energy absorbing material.

4. A roof system with reduced hail/fastener impact damage characteristics comprising:

a roof substrate having one or more layers of material;

at least one head of at least one fastener exposed at a top surface of said substrate;

at least two individual pieces of energy absorbing material that are non-metallic and positioned to discretely cover said heads of each individual fastener of said at least one fasteners, said at least two pieces including a first piece that is positioned and dimensioned to directly contact said head of said fastener, such that said first piece is affixed to said head of said fastener so as to cover a substantial entirety of a top surface of no other roofing component, and said at least two pieces including a second piece that is affixed to a relative top of said first pieces, wherein said second piece covers a substantial entirety of a top surface of a top surface of said first piece, and wherein said fastener is disposed entirely out of contact with said second piece; and a roof waterproofing membrane positioned atop all foregoing elements.

5. A roof system with reduced hail/fastener impact damage characteristics as claimed in claim 4 wherein said one or more layers of material includes insulation.

6. A roof system with reduced hail/fastener impact damage characteristics as claimed in claim 4 wherein said energy absorbing material is cover tape.

7. A roof system with reduced hail/fastener impact damage characteristics as claimed in claim 4 wherein said energy absorbing material is a self-sticking cover tape composed of cured ethylene propylene diene monomer (EPDM) membrane with a butyl gum rubber bottom.

8. A roof system with reduced hail/fastener impact damage characteristics as claimed in claim 6 wherein said cover tape is ethylene propylene diene monomer.

9. A roof system with reduced hail/fastener impact damage characteristics as claimed in claim 6 wherein said cover tape is self-adhesive tape.

10. A roof system with reduced hail/fastener impact damage characteristics comprising:

a roof substrate having one or more layers of material;

at least one top of at least one fastener exposed at a top surface of said substrate;

a roof waterproofing membrane positioned over said at least one fastener; and at least two individual piece of energy absorbing material that are non-metallic and positioned atop all forgoing elements and said waterproofing membrane to discretely cover said tops of each individual fastener of said at least one fasteners, said at least two pieces including a first piece that is positioned and dimensioned directly over said top of said fastener, such that said first piece is positioned and dimensioned to cover a substantial entirety of a top surface of no other roofing component, and said at least two pieces including a second piece that is affixed to a relative top of said first piece; and an adhesive applied to said first piece and said second piece, said adhesive adhering said first piece to said second piece, and said first piece to said waterproofing membrane.

11. A roof system with reduced hail/fastener impact damage characteristics as claimed in claim 10 wherein said energy absorbing material is cover tape.

* * * * *